US009765684B2

(12) United States Patent
Schroeder

(10) Patent No.: US 9,765,684 B2
(45) Date of Patent: Sep. 19, 2017

(54) VARIABLE FAN IMMERSION SYSTEM FOR CONTROLLING FAN EFFICIENCY

(71) Applicant: CNH Industrial America LLC, New Holland, PA (US)

(72) Inventor: Luke A. Schroeder, Coal Valley, IL (US)

(73) Assignee: CNH Industrial America LLC, New Holland, PA (US)

( * ) Notice: Subject to any disclaimer, the term of this patent is extended or adjusted under 35 U.S.C. 154(b) by 317 days.

(21) Appl. No.: 14/523,375

(22) Filed: Oct. 24, 2014

(65) Prior Publication Data

US 2016/0115857 A1 Apr. 28, 2016

(51) Int. Cl.

| | |
|---|---|
| ***F04D 29/05*** | (2006.01) |
| ***F01P 7/06*** | (2006.01) |
| ***F01P 5/06*** | (2006.01) |
| ***F01P 7/04*** | (2006.01) |
| ***F01P 11/12*** | (2006.01) |
| ***F04D 29/052*** | (2006.01) |

(52) U.S. Cl.

CPC ..... *F01P 7/06* (2013.01); *F01P 5/06* (2013.01); *F01P 7/04* (2013.01); *F01P 11/12* (2013.01); *F04D 29/052* (2013.01)

(58) Field of Classification Search

CPC .. F04D 13/021; F04D 15/0066; F04D 15/033; F04D 15/0055; F04D 15/061; F04D 19/002; F04D 29/325; F04D 29/36; F04D 29/46; F01P 5/06; F01P 7/04; F01P 7/06; F01P 11/12

See application file for complete search history.

(56) References Cited

U.S. PATENT DOCUMENTS

| | | | | | |
|---|---|---|---|---|---|
| 2,917,937 | A | * | 12/1959 | Dodge | F01P 7/046 123/41.11 |
| 2,995,295 | A | * | 8/1961 | Day | F01P 7/046 123/41.11 |
| 3,145,978 | A | | 8/1964 | Tolson | |
| 3,203,499 | A | * | 8/1965 | Bentz | B60K 11/04 123/41.12 |
| 3,872,842 | A | * | 3/1975 | Medley | F01P 7/046 123/41.11 |
| 4,387,780 | A | | 6/1983 | Fujikawa | |
| 4,413,947 | A | * | 11/1983 | Seki | F04D 29/526 123/41.49 |
| 5,564,899 | A | | 10/1996 | Na | |

(Continued)

FOREIGN PATENT DOCUMENTS

| | | |
|---|---|---|
| EP | 1 890 042 A1 | 2/2008 |
| JP | 51-134906 A | 11/1976 |

(Continued)

*Primary Examiner* — Igor Kershteyn

(74) *Attorney, Agent, or Firm* — Patrick M. Sheldrake

(57) ABSTRACT

A vehicle cooling system is provided having a heat exchanger, a cooling fan, and a fan shroud. The vehicle cooling system has a variable cooling fan immersion system that uses a control system and a variable cooling fan immersion depth adjustment mechanism to control the percentage of cooling fan immersion into the space enclosed by the fan shroud. The variable cooling fan immersion system is used to maximize the efficiency of a variable pitch cooling fan, a variable speed cooling fan drive, or both.

14 Claims, 6 Drawing Sheets

(56) References Cited

U.S. PATENT DOCUMENTS

| | | | | |
|---|---|---|---|---|
| 6,439,850 | B1 * | 8/2002 | McCallum | F04D 29/063 416/144 |
| 7,063,125 | B2 | 6/2006 | Tembreull et al. | |
| 7,585,149 | B2 | 9/2009 | Skotrikov et al. | |
| 8,408,169 | B2 | 4/2013 | Dybdal | |
| 8,408,170 | B2 | 4/2013 | Kardos et al. | |
| 2008/0031721 | A1 * | 2/2008 | Skotrikov | F01P 5/06 415/14 |
| 2010/0326376 | A1 * | 12/2010 | Dybdal | F01P 5/04 123/41.11 |
| 2011/0036311 | A1 * | 2/2011 | Kardos | F01P 7/026 123/41.59 |

FOREIGN PATENT DOCUMENTS

| | | | |
|---|---|---|---|
| JP | 59-46316 | A | 3/1984 |
| KR | 10-2008-0090648 | A | 10/2008 |

* cited by examiner

VARIABLE FAN IMMERSION SYSTEM FOR CONTROLLING FAN EFFICIENCY

BACKGROUND OF THE INVENTION

1. Field of the Invention

The present invention relates to fans for heat exchangers, and, more particularly, to cooling fans for radiators for internal combustion engines.

2. Description of the Related Art

A cooling fan for an internal combustion engine is typically mounted proximate to a heat exchanger, generally a coolant to air heat exchanger known as a radiator. Often, one or more additional heat exchangers, such as a charge air to ambient air heat exchanger, an exhaust gas recirculation heat exchanger, a transmission oil heat exchanger, a hydraulic oil heat exchanger, or an air conditioning condenser, are mounted in conjunction with the radiator. In order to provide for efficient cooling of these heat exchangers, a fan shroud adjoins the fan side of the heat exchanger combination, which directs cooling ambient air over the entire surface of the heat exchanger, and which prevents inefficient recirculating flow of cooling air through the cooling fan.

The cooling fan is mounted in relation to the fan shroud such that it is located partially within the fan shroud along its axial length, and partially outside the fan shroud. The proportion of the axial length of the cooling fan that is within the fan shroud is referred to as the depth or percentage of fan immersion. The depth or percentage of fan immersion has a large impact on the efficiency of the cooling fan in terms of volumetric air movement for a given amount of power consumption. For a cooling fan for an internal combustion engine that has a rotational speed that is either in a direct relationship to an engine rotational speed, or that has a rotational speed that is entirely fixed, such as an electrically driven fan, and that also has a fixed pitch of its cooling fan blades, the amount of fan immersion may be fixed according to an efficiency that is optimized for the average operating parameters of the machine or vehicle incorporating the internal combustion engine, i.e.—for a given ratio between the machine or vehicle forward speed and engine speed when the machine or vehicle is, for example, in high gear.

It is also known, for example in U.S. Pat. No. 8,408,170 (Kardos, et al), to provide a cooling fan that is moveable axially during vehicle operation, which axial movement is proportionate to the fan speed, which is itself in fixed proportion to the engine speed. Another reference, U.S. Pat. No. 4,387,780 (Fujikawa), describes a cooling fan that is also moveable axially during vehicle operation, with the axial movement being associated with the moveable sheave of a variable speed drive. However, the variable speed drive does not vary the speed of the fan relative to the engine speed, but is merely a variable speed final drive for propulsion of the vehicle, e.g. —a variable speed transmission.

As various machines and vehicles utilizing internal combustion engines and vehicle cooling systems become increasingly efficient, both in terms of fuel efficiency and in terms of exhaust emissions, it is desirable to maximize cooling fan efficiency, in order to move a maximum amount of air with a minimum amount of cooling fan power consumption. The amount of power used to drive a cooling fan is not inconsiderable, and can be as much as seventy horsepower in a large commercial vehicle or similar application. Furthermore, the necessary heat rejection may take place with a heat exchanger or exchangers that are subject to physical size constraints due to aerodynamic or aesthetic considerations. In order to accomplish these ends, it is known to utilize a variable pitch cooling fan.

SUMMARY OF THE INVENTION

The present invention provides a variable cooling fan immersion system for use with a variable pitch cooling fan or with a variable speed cooling fan drive, or both.

The invention in one form is directed to a machine having an internal combustion engine, which is provided with a variable cooling fan immersion system including a variable cooling fan immersion depth adjustment mechanism and a variable pitch cooling fan.

The invention in another form is directed to a variable cooling fan immersion system including a variable cooling fan immersion depth adjustment mechanism and a variable pitch cooling fan.

The invention in yet another form is directed to a variable cooling fan immersion system including a variable cooling fan immersion depth adjustment mechanism and a variable speed cooling fan drive.

An advantage of the present invention is that the efficiency of a variable pitch cooling fan can be maintained and optimized relative to the percentage of cooling fan immersion as the angle of the variable pitch cooling fan blade angle changes. This efficiency may be maximized by maintaining the variable pitch cooling fan at a fixed percentage of immersion throughout the range of variable pitch cooling fan blade angles, or may alternately be maximized by adjusting the percentage of immersion as a function of the variable pitch cooling fan blade angle and one or more additional factors.

Another advantage is that the efficiency of a variable speed cooling fan drive can be maintained and optimized relative to the percentage of cooling fan immersion as the cooling fan rotational speed to engine rotational speed ratio changes.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates embodiment of the invention, in one form, and such exemplification is not to be construed as limiting the scope of the invention in any manner.

DETAILED DESCRIPTION OF THE INVENTION

Figure 1:
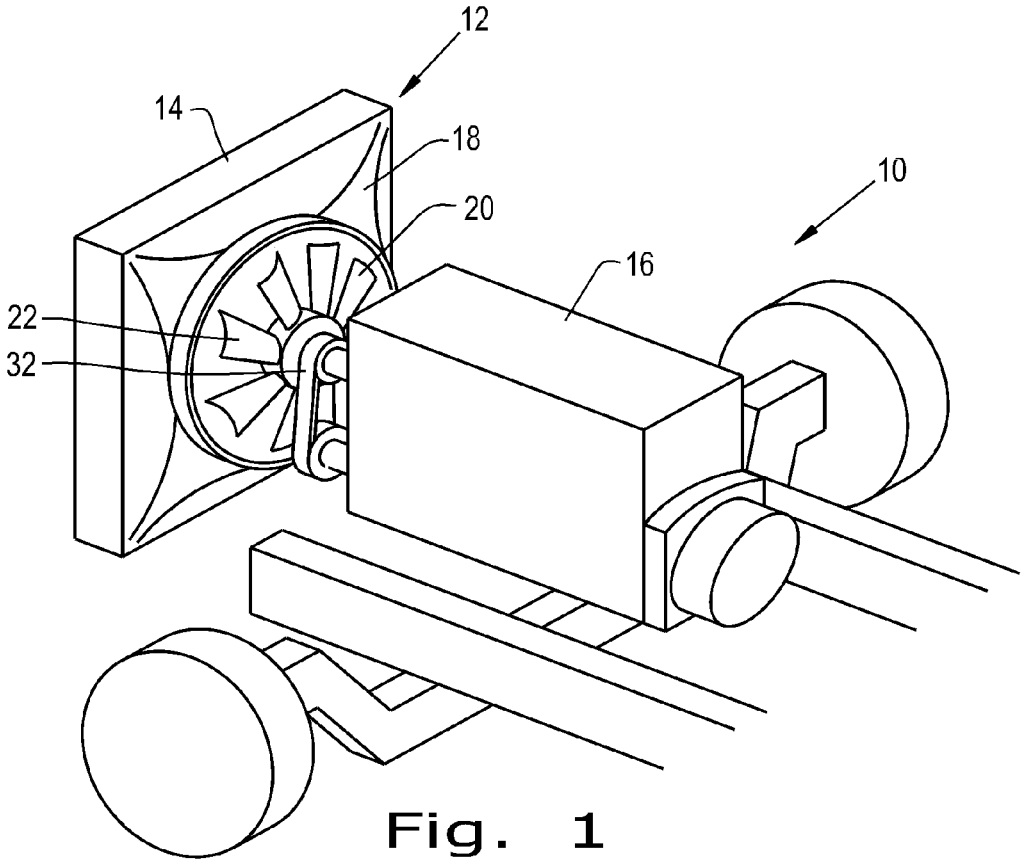
FIG. 1 is a top perspective view of an embodiment of a machine having an engine of the present invention, in the form of a vehicle with an engine, a vehicle cooling system with a heat exchanger and a fan shroud, and a cooling fan.

Referring now to the drawings, and more particularly FIG. 1, there is shown an embodiment of a vehicle or machine 10 of the present invention. The embodiment shown is a forward travelling machine, such as a road-going vehicle. However, this embodiment is illustrative only, and the present invention may be embodied in any number of machines utilizing an internal combustion engine and heat exchanger, such as agricultural machines like tractors and combine harvesters, construction machines like bulldozers and excavators, rail-going machines like locomotives, or non-moving machines like stationary power generators. The vehicle or machine 10 is provided with an engine 16 and a vehicle cooling system 12. The vehicle cooling system 12 is made up of one or more heat exchangers 14, which may include a coolant to air heat exchanger known as a radiator, and may additionally include a charge air to ambient air heat exchanger, an exhaust gas recirculation heat exchanger, a transmission oil heat exchanger, a hydraulic oil heat exchanger, or an air conditioning condenser. A cooling fan 20 is located adjacent to the heat exchanger 14, and serves in this embodiment to draw air through the heat exchanger 14. Alternate embodiments may be so configured that the vehicle cooling system 12 is located elsewhere in the vehicle or machine 10, such as in the rear of the vehicle or machine 10, laterally in the side of the vehicle or machine 10, or horizontally in the top of the vehicle or machine 10. In these alternate embodiments, the cooling fan 20 may either function to draw air through the heat exchanger 14 or to blow air through the heat exchanger 14.

The cooling fan 20 in the embodiment of FIG. 1 is driven by a cooling fan drive 32, which is shown to be directly driven by the engine 16. Alternate embodiments of the cooling fan drive 32 may be directly driven with a fixed rotation ratio with the engine 16, directly driven with a passively variable rotation ratio with the engine 16, directly driven with an actively variable rotation ratio with the engine 16, hydraulically driven with fixed or variable rotation ratio with the engine 16, pneumatically driven with fixed or variable rotation ratio with the engine 16, or electrically driven with a fixed rate of rotation, or in fixed or variable rotation ratio with the engine 16.

In order to direct air flow through the entirety of the surface of the heat exchanger 14 and to prevent unwanted and inefficient air recirculation through the cooling fan 20, a fan shroud 18 is provided between the heat exchanger 14 and the cooling fan 20, which fan shroud 18 closely abuts the ends of the cooling fan blades 22 of the cooling fan 20. The depth to which the cooling fan 20 penetrates axially into the space enclosed by the fan shroud 18 is critical to the performance of the cooling fan 20 in terms of volumetric airflow and resultant performance of the vehicle cooling system 12, versus the amount of power consumed by the cooling fan 20. This amount of axial penetration of the cooling fan 20 is referred to as the percentage of cooling fan immersion or cooling fan immersion depth. For the sake of discussion, the amount of the axial length of the cooling fan 20 that does not penetrate the space enclosed by the fan shroud 18 will be referred to as the percentage of cooling fan protrusion or cooling fan protrusion height.

For a cooling fan 20 that is both fixed in its rotation ratio with the engine 16 and fixed in the pitch of its cooling fan blades 22, the percentage of cooling fan 20 immersion can be optimized, because there is only one percentage of cooling fan immersion set point that optimizes cooling fan power consumption to volumetric airflow rate through the vehicle cooling system 12. This optimized percentage of cooling fan immersion for a cooling fan 20 that is both fixed in its rotation ratio with the engine 16 and fixed in the pitch of its cooling fan blades 22 is typically about sixty three percent. However, a problem arises when a variable pitch cooling fan or when a variable speed cooling fan drive, or both, is used in the design of the vehicle cooling system 12. In a vehicle cooling system 12 that uses a variable speed cooling fan drive, this is because the percentage of cooling fan immersion that is optimal over the full range of engine 16 rotational speeds may not be optimal at one or more rotational speeds at which the variable speed cooling fan drive is configured to operate. In a vehicle cooling system 12 that uses a variable pitch cooling fan, this is because the percentage of cooling fan immersion that is optimal at one variable pitch cooling fan blade angle may not be optimal at a different variable pitch cooling fan blade angle. This is especially true on variable pitch cooling fans that have a percentage of cooling fan immersion that places the midline about which the variable pitch cooling fan blades rotate at a location other than the plane of the opening of the fan shroud 18.

Figure 2:
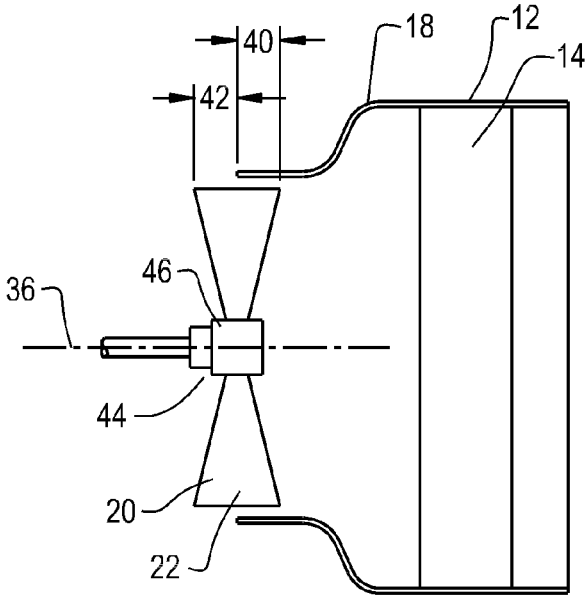
FIG. 2 is a cross sectional side view of the vehicle cooling system of FIG. 1, showing the heat exchanger, the fan shroud, the cooling fan, and a variable cooling fan immersion system, and also illustrating the percentage of cooling fan immersion and the percentage of cooling fan protrusion.
Figure 3:
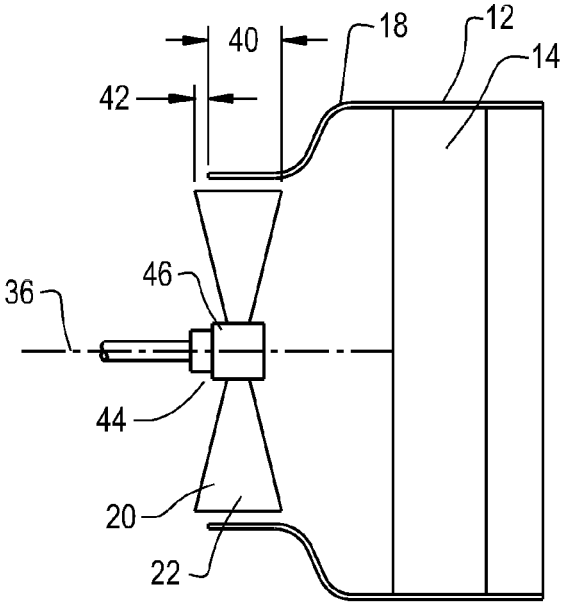
FIG. 3 is a cross sectional side view of the vehicle cooling system and variable cooling fan immersion system of FIG. 2, illustrating the variable cooling fan immersion system in a position of proportionately great cooling fan immersion.
Figure 4:
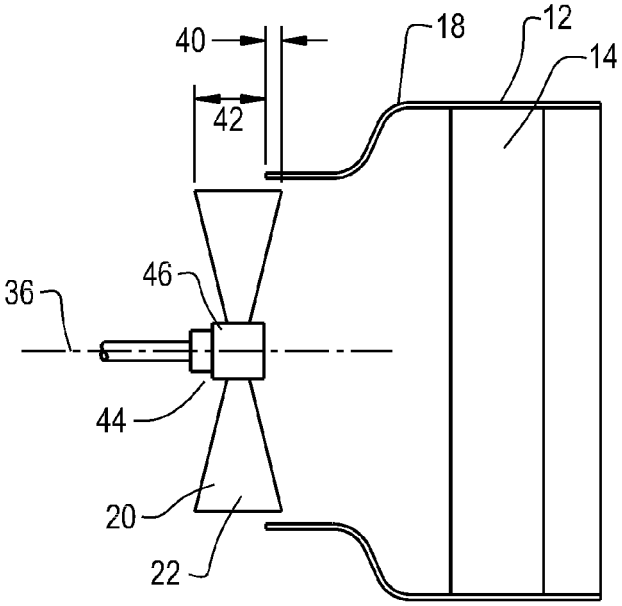
FIG. 4 is a cross sectional side view of the vehicle cooling system and variable cooling fan immersion system of FIGS. 2 and 3, illustrating the variable cooling fan immersion system in a position of proportionately small cooling fan immersion.

FIGS. 2 through 5 show cross sectional side views of a vehicle cooling system 12 and variable cooling fan immersion system 44. The vehicle cooling system 12 is again provided with at least one heat exchanger 14 and a fan shroud 18, which fan shroud 18 closely abuts the ends of the cooling fan blades 22 of the cooling fan 20, or as in FIG. 5 closely abuts the ends of the variable pitch cooling fan blades 26 of the variable pitch cooling fan 24. The variable cooling fan immersion system 44 incorporates a variable cooling fan immersion depth adjustment mechanism 46, which serves to move the cooling fan 20 or variable pitch cooling fan 24 along its cooling fan axis 36 further in or further out of the space enclosed by the fan shroud 18. The percentage of cooling fan immersion or cooling fan immersion depth is represented by item number 40, and the percentage of cooling fan protrusion or cooling fan protrusion height is represented by item number 42. In FIG. 2, the cooling fan 20 is approximately centered in the plane of the opening of the fan shroud 18. In FIG. 3, the cooling fan 20 is moved to a location of greater percentage of cooling fan immersion 40. In FIG. 4, the cooling fan 20 is moved to a location of lesser percentage of cooling fan immersion 40.

Figure 5:
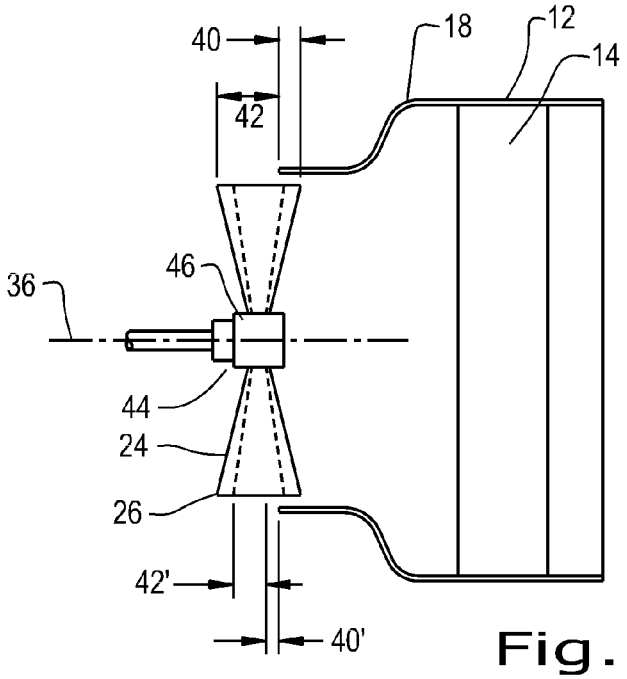
FIG. 5 is a cross sectional side view of a vehicle cooling system and variable cooling fan immersion system, similar to FIGS. 2 through 4, illustrating variation in the percentage of cooling fan immersion as a result of changing variable pitch fan blade angles when using a variable pitch cooling fan.

FIG. 5 illustrates the principle that, for a variable pitch cooling fan 24 having the midline about which the variable pitch cooling fan blades 26 rotate at a location other than the plane of the opening of the fan shroud 18, changing the variable pitch cooling fan blade angle and the resultant overall length of the variable pitch cooling fan 24 along its cooling fan axis 36, varies the percentage of cooling fan immersion 40. Specifically, the variable pitch cooling fan 24 having its variable pitch cooling fan blades 26 at a steep pitch is represented by the solid line fan outline, with resulting cooling fan immersion depth 40 and cooling fan protrusion height 42. As can be seen, the proportion of cooling fan immersion depth 40 to cooling fan protrusion height 42 is relatively large. The variable pitch cooling fan 24 having its variable pitch cooling fan blades 26 at a shallow pitch is represented by the dotted line fan outline, with resulting cooling fan immersion depth 40' and cooling fan protrusion height 42'. As can be seen, the proportion of cooling fan immersion depth 40' to cooling fan protrusion height 42' is relatively small, and could even go to zero.

Figure 6:
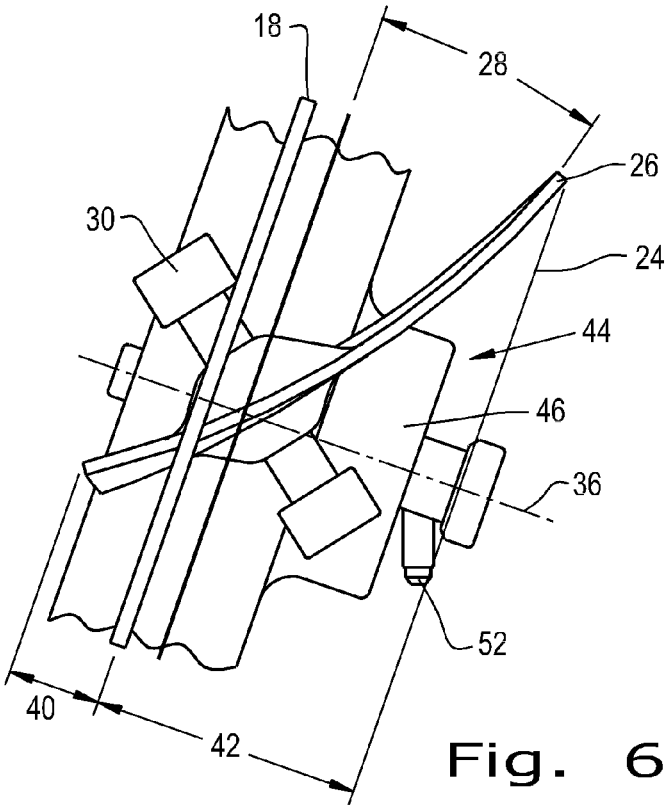
FIG. 6 is a side view of a variable cooling fan immersion system with a variable cooling fan immersion depth adjustment mechanism and a variable pitch cooling fan.

FIG. 6 shows a variable pitch cooling fan 24 connected to a variable cooling fan immersion system 44 of the present invention. The variable pitch cooling fan 24 is provided with variable pitch cooling fan blades 26 which are rotatable to various variable pitch cooling fan blade angles 28 by means of variable pitch cooling fan blade actuators 30. The variable pitch cooling fan 24 rotates around its cooling fan axis 36, and is connected to a variable cooling fan immersion depth adjustment mechanism 46 of the variable cooling fan immersion system 44. The variable cooling fan immersion depth adjustment mechanism 46 has a hydraulic connection 52, by which it moves the variable pitch cooling fan 24 along its cooling fan axis 36 further in or further out of the space enclosed by the fan shroud 18, thereby changing the cooling fan immersion depth 40 and cooling fan protrusion height 42.

Figure 7A:
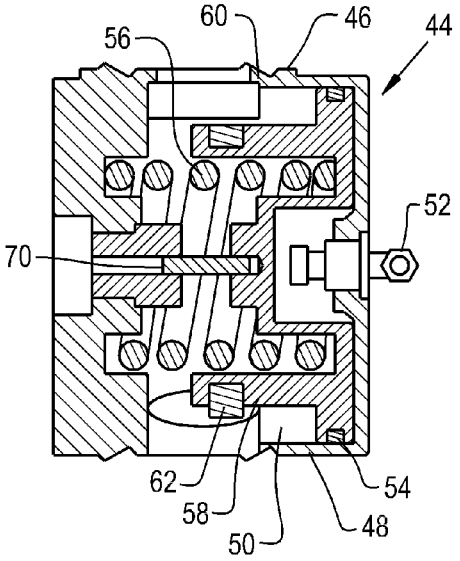
FIG. 7A is a cross sectional side view of an embodiment of a variable cooling fan immersion depth adjustment mechanism used in the variable cooling fan immersion system of the present invention, shown in a position of zero percent cooling fan immersion.
Figure 7B:
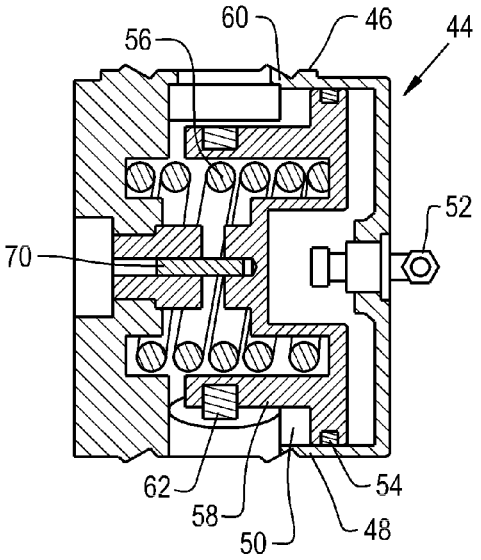
FIG. 7B is a cross sectional side view of the variable cooling fan immersion depth adjustment mechanism shown in FIG. 7A, now shown in a position of fifty percent cooling fan immersion.
Figure 7C:
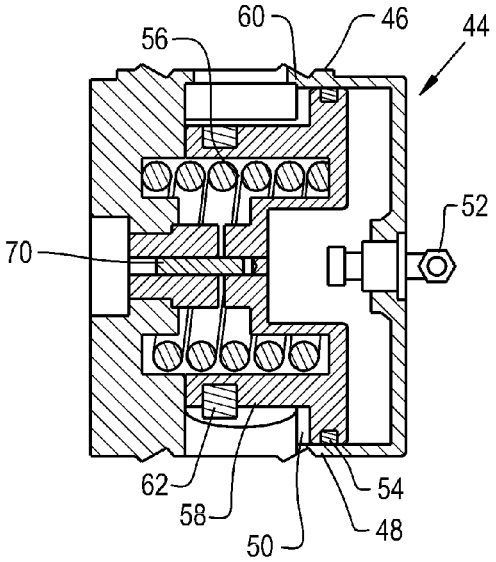
FIG. 7C is a cross sectional side view of the variable cooling fan immersion depth adjustment mechanism shown in FIGS. 7A and 7B, now shown in a position of one hundred percent cooling fan immersion.

FIGS. 7A, 7B, and 7C are cross sectional side views of an embodiment of a variable cooling fan immersion depth adjustment mechanism 46 used in the variable cooling fan immersion system 44 of the present invention. The variable cooling fan immersion depth adjustment mechanism 46 is provided with a hydraulic device 50 with an inner hub 58 and an outer hub 60, which together define a hydraulic actuator 48. Hydraulic cylinder seals 54 provide sliding engagement between the inner hub 58 and the outer hub 60, while a drive spline 62 provides torsional communication between the inner hub 58 and the outer hub 60. A hydraulic connection 52 communicates hydraulic pressure to the hydraulic actuator 48, which then acts against a return spring 56 to move the variable pitch cooling fan along its cooling fan axis. A cooling fan position sensor 70 is provided, by which the variable cooling fan immersion system 44 receives feedback on the state of the variable cooling fan immersion depth adjustment mechanism 46.

FIG. 7A shows the variable cooling fan immersion depth adjustment mechanism 46 in a position of zero percent cooling fan immersion. FIG. 7B shows the variable cooling fan immersion depth adjustment mechanism 46 in a position of fifty percent cooling fan immersion. FIG. 7C shows the variable cooling fan immersion depth adjustment mechanism 46 in a position of one hundred percent cooling fan immersion.

Figure 8:
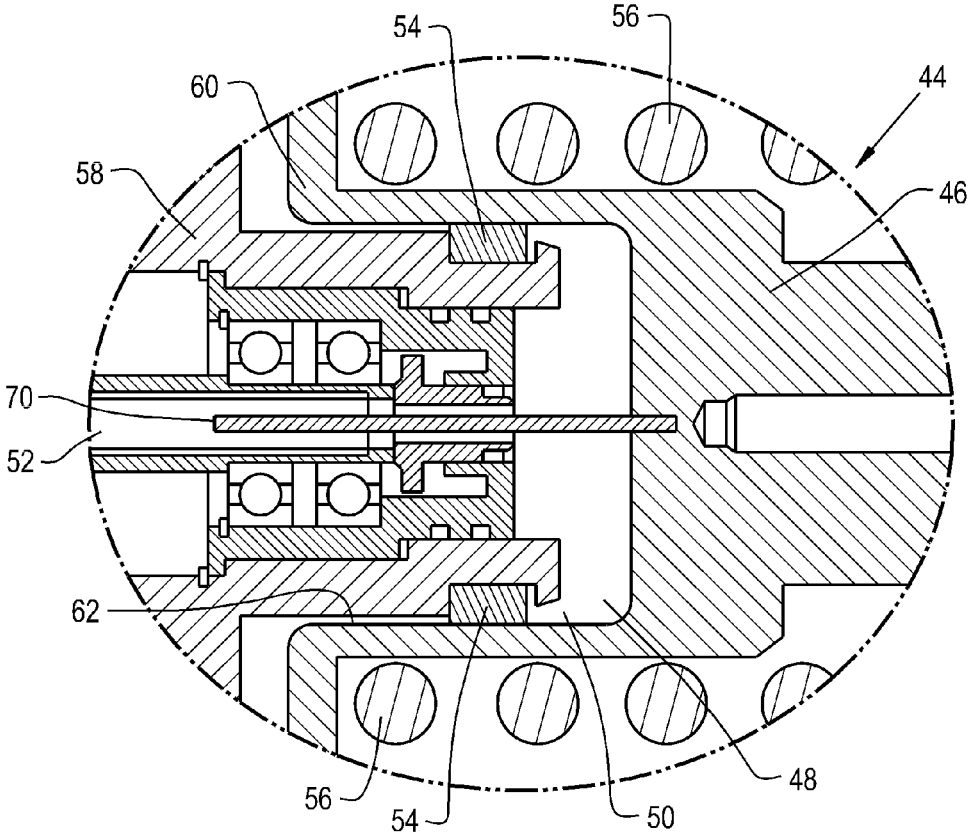
FIG. 8 is a detail cross sectional view of another embodiment of a variable cooling fan immersion depth adjustment mechanism used in the variable cooling fan immersion system of the present invention.

FIG. 8 is a detail cross sectional side view of an embodiment of a variable cooling fan immersion depth adjustment mechanism 46 used in the variable cooling fan immersion system 44 of the present invention. As with FIGS. 7A, 7B, and 7C, the variable cooling fan immersion depth adjustment mechanism 46 of FIG. 8 is provided with a hydraulic device 50 with an inner hub 58 and an outer hub 60, which together define a hydraulic actuator 48. Hydraulic cylinder seals 54 provide sliding engagement between the inner hub 58 and the outer hub 60, while a drive spline 62 provides torsional communication between the inner hub 58 and the outer hub 60. A hydraulic connection 52 communicates hydraulic pressure to the hydraulic actuator 48, which then acts against a return spring 56 to move the variable pitch cooling fan along its cooling fan axis. A cooling fan position sensor 70 is provided, by which the variable cooling fan immersion system receives feedback on the state of the variable cooling fan immersion depth adjustment mechanism 46.

Figure 9:
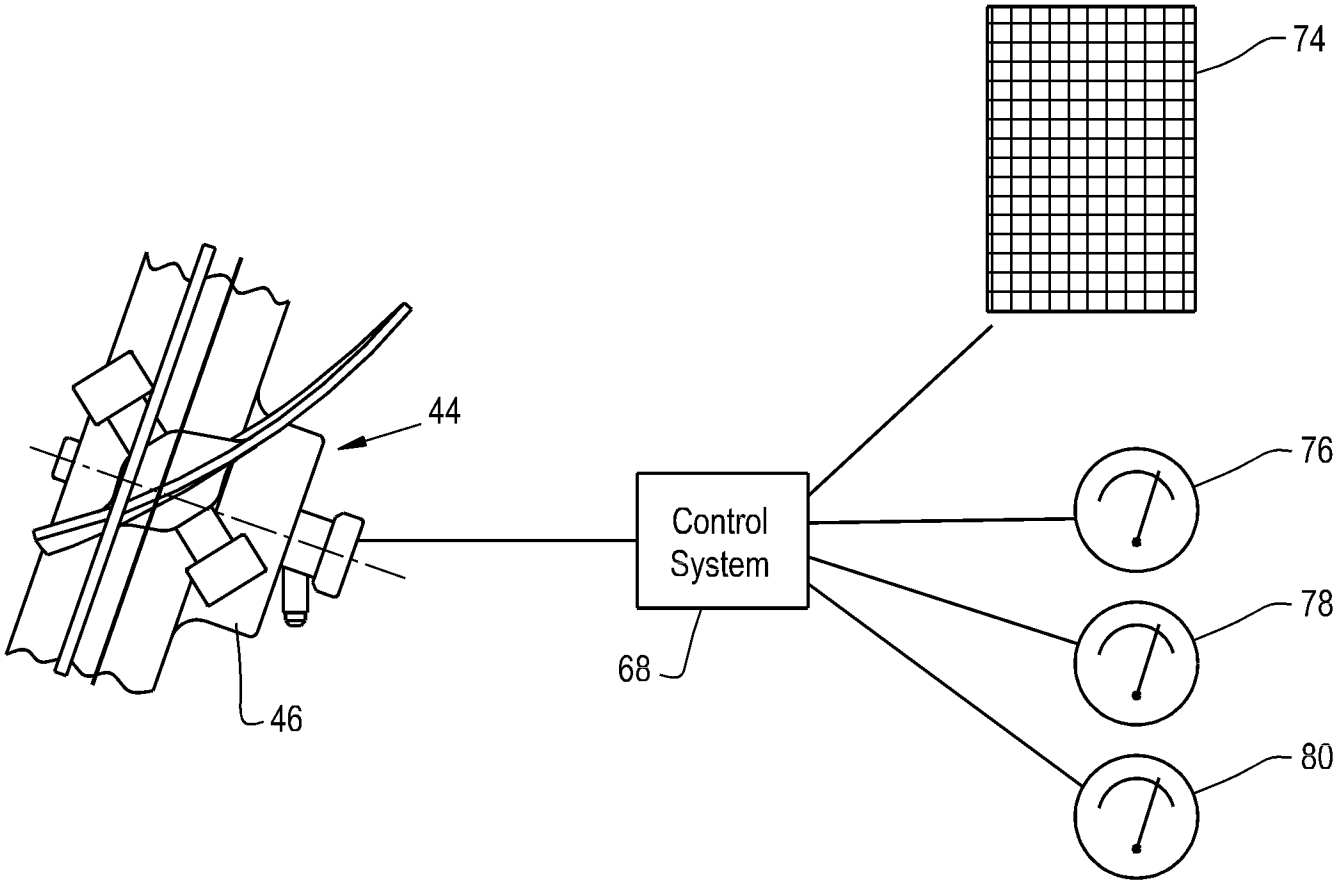
FIG. 9 is an illustration of a variable cooling fan immersion control system.

The variable cooling fan immersion system 44 of the present invention incorporates a variable cooling fan immersion control system 68 connected to the variable cooling fan immersion depth adjustment mechanism 46 as shown in FIG. 9. The variable cooling fan immersion control system 68 solves the problem of having the percentage of cooling fan immersion depend fixedly and detrimentally upon the variable pitch cooling fan blade angle as has been illustrated in FIG. 5, and further provides additional advantages of being able to control the percentage of cooling fan immersion as an optimized function of one or both of the variable pitch cooling fan blade angle and the variable speed cooling fan drive ratio. This optimized function may maintain the percentage of cooling fan immersion at a fixed value throughout a range of variable pitch cooling fan blade angles when the location of the midline about which the variable pitch cooling fan blades rotate is other than the plane of the opening of the fan shroud.

More preferably, the optimized function utilized by the variable cooling fan immersion control system 68 may set the percentage of cooling fan immersion to a value that correlates with a maximum efficiency derived from the variable pitch cooling fan blade angles or the variable speed cooling fan drive ratio, or both. Furthermore, the variable cooling fan immersion control system 68 may derive the percentage of cooling fan immersion that correlates with a maximum efficiency from additional factors, such as input from a vehicle speed sensor 76, an engine rotational speed sensor 78, a coolant temperature sensor 80, calculated engine power output, and ambient temperature and atmospheric pressure. In order to determine the percentage of cooling fan immersion to a value that correlates with a maximum efficiency, the variable cooling fan immersion control system 68 may utilize a look-up table 74.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine having an engine, comprising:

a variable cooling fan immersion system, said variable cooling fan immersion system having a variable cooling fan immersion depth adjustment mechanism; and a variable pitch cooling fan;

said variable cooling fan immersion system includes a variable cooling fan immersion control system connected to said variable cooling fan immersion depth adjusting mechanism, said variable cooling fan immersion control system having at least one cooling fan position sensor;

wherein said variable cooling fan immersion control system is operable to at least one of:

maintain said variable pitch cooling fan at a fixed percentage of immersion throughout a range of variable pitch cooling fan blade angles; and adjust said variable pitch cooling fan to a varying percentage of immersion throughout a range of variable pitch cooling fan blade angles.

2. The machine having an engine of claim 1, further comprising:

a variable speed cooling fan drive.

3. The machine having an engine of claim 1, wherein:

said variable cooling fan immersion depth adjustment mechanism further comprises at least one hydraulic actuator, said at least one hydraulic actuator including a hydraulic device with an inner hub, an outer hub, a drive spline between said inner hub and said outer hub, and a return spring.

4. The machine having an engine of claim 3, wherein:

said variable cooling fan immersion control system is integrated into an engine control unit of the engine of the machine.

5. The vehicle having an engine of claim 1, wherein:

said variable cooling fan immersion control system utilizes a look-up table, said look-up-table providing a cooling fan immersion depth as a function of a variable pitch cooling fan blade angle and at least one additional factor, said at least one additional factor being selected from the group consisting of machine speed, engine rotational speed, engine power output, engine temperature, coolant temperature, cooling fan rotational speed, cooling fan rotational speed to engine rotational speed ratio, ambient temperature, and atmospheric pressure.

6. A variable cooling fan immersion system, comprising:

a variable cooling fan immersion depth adjustment mechanism; and a variable pitch cooling fan;

a variable cooling fan immersion control system connected to said variable cooling fan immersion depth adjusting mechanism, said variable cooling fan immersion control system having at least one cooling fan position sensor;

wherein said variable cooling fan immersion control system is operable to adjust said variable pitch cooling fan to a varying percentage of immersion throughout a range of variable pitch cooling fan blade angles.

7. The variable cooling fan immersion system of claim 6, further comprising:

a variable speed cooling fan drive.

8. The variable cooling fan immersion system of claim 7, wherein:

said variable cooling fan immersion depth adjustment mechanism further comprises at least one hydraulic actuator, said at least one hydraulic actuator including a hydraulic device with an inner hub, an outer hub, a drive spline between said inner hub and said outer hub, and a return spring.

9. The variable cooling fan immersion system of claim 7, wherein:

said variable cooling fan immersion control system is integrated into an engine control unit of an engine of a machine.

10. The variable cooling fan immersion system of claim 7, wherein:

said variable cooling fan immersion control system utilizes a look-up table, said look-up-table providing a cooling fan immersion depth as a function of a variable pitch cooling fan blade angle and at least one additional factor, said at least one additional factor being selected from the group consisting of machine speed, engine rotational speed, engine power output, engine temperature, coolant temperature, cooling fan rotational speed, cooling fan rotational speed to engine rotational speed ratio, ambient temperature, and atmospheric pressure.

11. A variable cooling fan immersion system, comprising:

a variable cooling fan immersion depth adjustment mechanism; and a variable pitch cooling fan;

a variable cooling fan immersion control system connected to said variable cooling fan immersion depth adjusting mechanism, said variable cooling fan immersion control system having at least one cooling fan position sensor; and wherein said variable cooling fan immersion control system is operable to maintain said variable pitch cooling fan at a fixed percentage of immersion throughout a range of variable pitch cooling fan blade angles.

12. A variable cooling fan immersion system, comprising:

a variable cooling fan immersion depth adjustment mechanism; and a variable speed cooling fan drive;

a variable cooling fan immersion control system connected to said variable cooling fan immersion depth adjusting mechanism, said variable cooling fan immersion control system having at least one sensor to provide feedback on the position of the cooling fan;

said variable cooling fan immersion control system determines a cooling fan immersion depth as a function of a cooling fan rotational speed to engine rotational speed ratio and at least one additional factor, said at least one additional factor being selected from the group consisting of machine speed, engine rotational speed, engine power output, engine temperature, coolant temperature, ambient temperature, and atmospheric pressure.

13. The variable cooling fan immersion system of claim 12, wherein:

said variable cooling fan immersion depth adjustment mechanism further comprises at least one hydraulic actuator, said at least one hydraulic actuator including a hydraulic device with an inner hub, an outer hub, a drive spline between said inner hub and said outer hub, and a return spring.

14. A variable cooling fan immersion system, comprising:

a variable cooling fan immersion depth adjustment mechanism; and at least one of a variable pitch cooling fan;

a variable cooling fan immersion control system connected to said variable cooling fan immersion depth adjusting mechanism, said variable cooling fan immersion control system having at least one cooling fan position sensor;

said variable cooling fan immersion depth adjustment mechanism further comprises at least one hydraulic actuator, said at least one hydraulic actuator including a hydraulic device with an inner hub, an outer hub, a drive spline between said inner hub and said outer hub, and a return spring.

* * * * *